US007263958B2

(12) United States Patent
Miyazaki et al.

(10) Patent No.: US 7,263,958 B2
(45) Date of Patent: Sep. 4, 2007

(54) VALVE DRIVE MECHANISM IN AN INTERNAL COMBUSTION ENGINE

(75) Inventors: Satoshi Miyazaki, Shizuoka-ken (JP); Masanori Takahashi, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 106 days.

(21) Appl. No.: 11/274,035

(22) Filed: Nov. 15, 2005

(65) Prior Publication Data

US 2006/0102123 A1 May 18, 2006

(30) Foreign Application Priority Data

Nov. 18, 2004 (JP) ..... 2004-335026

(51) Int. Cl.
*F01L 1/02* (2006.01)

(52) U.S. Cl. ..... 123/90.31; 123/195 A

(58) Field of Classification Search ..... 123/90.31, 123/195 A

See application file for complete search history.

(56) References Cited

U.S. PATENT DOCUMENTS 6,213,072 B1 * 4/2001 Sayama et al. ..... 123/90.31

FOREIGN PATENT DOCUMENTS

JP 2001-073729 3/2001

* cited by examiner

*Primary Examiner*—Thomas Denion
*Assistant Examiner*—Zelalem Eshete
(74) *Attorney, Agent, or Firm*—Knobbe, Martens, Olson & Bear, LLP

(57) ABSTRACT

A valve drive mechanism is configured for an internal combustion engine that includes an outer body formed, at least in part, from a crankcase and a cylinder that protrudes from the crankcase. The valve drive mechanism comprises a drive gear that is mounted to a crankshaft supported on the crankcase. A shaft is supported for rotation by a bearing. A driven gear is mounted to the shaft. The driven gear is configured to mesh with the drive gear. A drive pulley is mounted to the shaft. A driven pulley is mounted to a camshaft supported on the cylinder. A transmitter member extends between the drive pulley and the driven pulley. A bracket, which is a separate component from the engine outer body, is configured to be mounted to the engine outer body. The bracket is configured to support the bearing and the rotating shaft. The bracket, the bearing, the rotating shaft, the driven gear, the drive pulley and the bracket are assembled together as a unit that can be mounted to the outer body.

24 Claims, 5 Drawing Sheets

VALVE DRIVE MECHANISM IN AN INTERNAL COMBUSTION ENGINE

PRIORITY INFORMATION

This application claims priority under 35 U.S.C. § 119 to Japanese Patent Application No. 2004-335026, filed on Nov. 18, 2004, the entire content of which is expressly incorporated by reference herein.

BACKGROUND OF THE INVENTION

1. Field of the Invention

This invention relates to an internal combustion engine and, more particularly, to a valve drive mechanism for an internal combustion engine.

2. Description of the Related Art

Japanese patent publication JP-A-2001-73729 describes a valve drive mechanism for an internal combustion engine. In this patent publication, the internal combustion engine comprises an engine outer shell or body that is formed by a crankcase and a cylinder that protrudes from the crankcase. The valve drive mechanism includes a drive gear mounted to a crankshaft that is, in turn, supported by the crankcase. A rotating shaft is supported on the engine outer body by a bearing. A driven gear is mounted to the rotating shaft and meshes with the drive gear. A drive pulley is mounted to the rotating shaft. A driven pulley, in turn, is mounted to a camshaft that is supported by the cylinder. A transmitter member (e.g., a belt) is stretched over the drive pulley and driven pulley. In this device, the drive and driven gears form a reduction gear between the crankshaft and the camshaft to reduce the size of the overall valve drive mechanism.

In the valve drive mechanism described above, when the internal combustion engine is operated, part of the drive force outputted from the crankshaft is transmitted to the camshaft through the drive gear, the driven gear, the rotating shaft, the drive pulley, the transmitter member and the driven pulley in this order. Then, the intake and exhaust valves are moved in association with the camshaft to maintain operation of the internal combustion engine.

SUMMARY OF THE INVENTION

With respect to the above-described prior art, Applicant recognized certain disadvantages associated with mounting the bearing directly to the engine outer body. As described above, the driven gear is supported on the engine outer body by the bearing through the rotating shaft. Thus, in this arrangement, when the valve drive mechanism is assembled, it is necessary for the bearing to be first mounted to the engine outer body, and then the driven gear or the rotating shaft can be assembled to the bearing. That is, components of the valve drive mechanism need to be assembled separately. This tends to result in a difficult and time-consuming assembly process.

Accordingly, one aspect of the present invention comprises a valve drive mechanism for an internal combustion engine that includes an outer body formed, at least in part, from a crankcase and a cylinder head assembly that protrudes from the crankcase. The valve drive mechanism comprises a drive gear that is mounted on a crankshaft supported on the crankcase. A shaft is supported for rotation by a bearing. A driven gear is mounted on the shaft. The driven gear is configured to mesh with the drive gear. A drive pulley is mounted to the shaft. A driven pulley is mounted on a camshaft supported on the cylinder. A transmitter member extends between the drive pulley and the driven pulley. A bracket is a separate component from the engine outer body and is configured to be mounted to the engine outer body. The bracket is configured to support the bearing and the rotating shaft. The bracket, the bearing, the rotating shaft, the driven gear, the drive pulley and the bracket form a unit that is configured to be mounted together to the outer body.

Another aspect of the present invention comprises a valve drive mechanism for an internal combustion engine that includes a crankcase, a cylinder body that protrudes from the crankcase, a generally vertically extending crankshaft, and a drive gear coupled to an upper portion of the crankshaft. The valve drive mechanism comprises a pre-assembled unit that includes a bracket. A bearing is coupled to the bracket. A shaft is journalled for rotation by the bearing. A driven gear is coupled to the shaft and is configured to be engaged and driven by the drive gear. A drive pulley is coupled to the shaft. A transmitter member can be placed over the drive pulley and over a driven pulley that is coupled to a camshaft of the internal combustion engine.

Another aspect of the present invention comprises a valve drive mechanism for an internal combustion engine that includes a crankcase, a cylinder that protrudes from the crankcase, a generally vertically extending crankshaft, and a drive gear coupled to an upper portion of the crankshaft. The valve drive mechanism comprises a bearing and a shaft that is journalled for rotation by the bearing. A driven gear is coupled to the shaft and is configured to be engaged and driven by the drive gear. A drive pulley is coupled the shaft. A transmitter member can be placed over the drive pulley and over a driven pulley that is coupled to a camshaft of the internal combustion engine. The mechanism also includes means for coupling the drive gear, the shaft, and the pulley to the engine as a pre-assembled unit that can be coupled to the crankcase or cylinder.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general structure that implements various features of specific embodiments of the invention will now be described with reference to the drawings. The drawings and the associated descriptions are provided to illustrate embodiments of the invention and not to limit the scope of the invention.

DETAILED DESCRIPTION OF THE PREFERRED EMBODIMENTS

Figure 1:
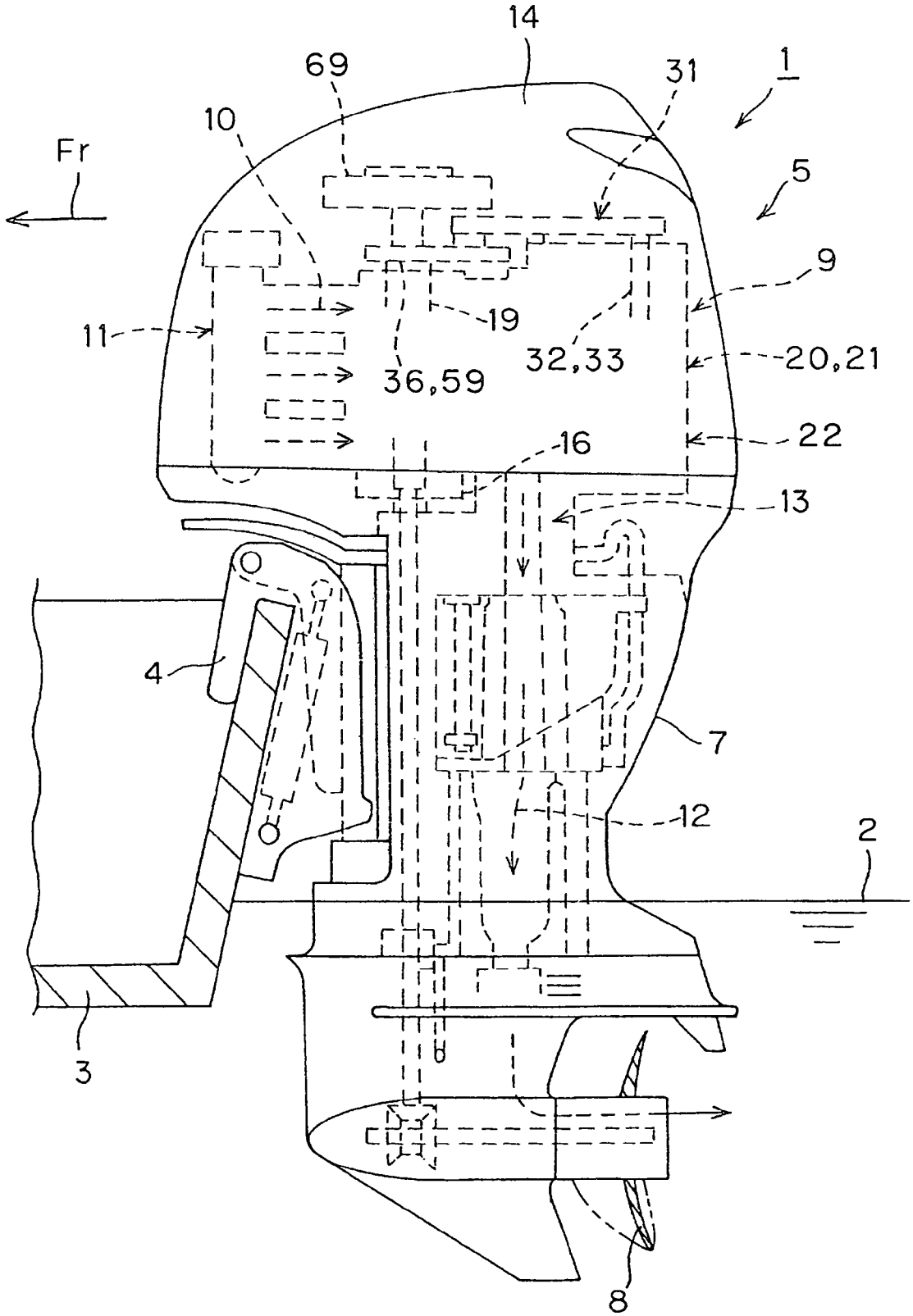
FIG. 1 is a side elevational view an outboard motor that comprises a valve drive mechanism having certain feature and advantages according to a preferred embodiment of the present invention.

FIG. 1 is a partial side cross-sectional view of the stem end of a small watercraft 1 that includes a hull 3 floating on the surface of water 2. FIG. 1 also shows a side elevational view of an outboard motor 5 that is supported by a clamping bracket 4 at the stem of the hull 3. An arrow in FIG. 1 indicates the front in the propulsive direction of the watercraft 1. As will be explained in detail below, the outboard motor 5 includes a valve drive mechanism 31 (see FIG. 2) that includes certain features and advantages according to an embodiment of the present invention.

In the illustrated embodiment, the outboard motor 5 can have an elongated casing 7 that extends in a generally vertical direction. The casing 7 can be supported on the hull 3 through the clamping bracket 4. A propeller 8 can be supported for rotation at the lower end of the casing 7. An internal combustion engine 9 can be supported at the upper end of the casing 7. The engine 9 can be drivingly connected to the propeller 8 in any of a variety of manners as is well know in the art.

With continued reference to FIG. 1, an intake device 11 can extend from the internal combustion engine 9. The intake device 11 is configured to suck outside air 10 into the internal combustion engine 9. The motor 5 can also include an exhaust device 13, which can be configured to discharge exhaust gas 12 discharged from the internal combustion engine 9 into the body of water 2. The motor 5 can also include a cowling 14 that is configured to cover the internal combustion engine 9 and the intake device 11 as a whole from the outside.

The engine 9 and the valve drive mechanism 31 are described in the context of an outboard motor 5 because certain features and aspects of the present invention are particularly advantageous in an outboard motor. However, it is anticipated that various features, aspects and advantages of the engine 9 and/or valve train device 31 described herein can be applied to other applications, such as, for example, other marine applications, land vehicles, and/or stationary applications.

Figure 2:
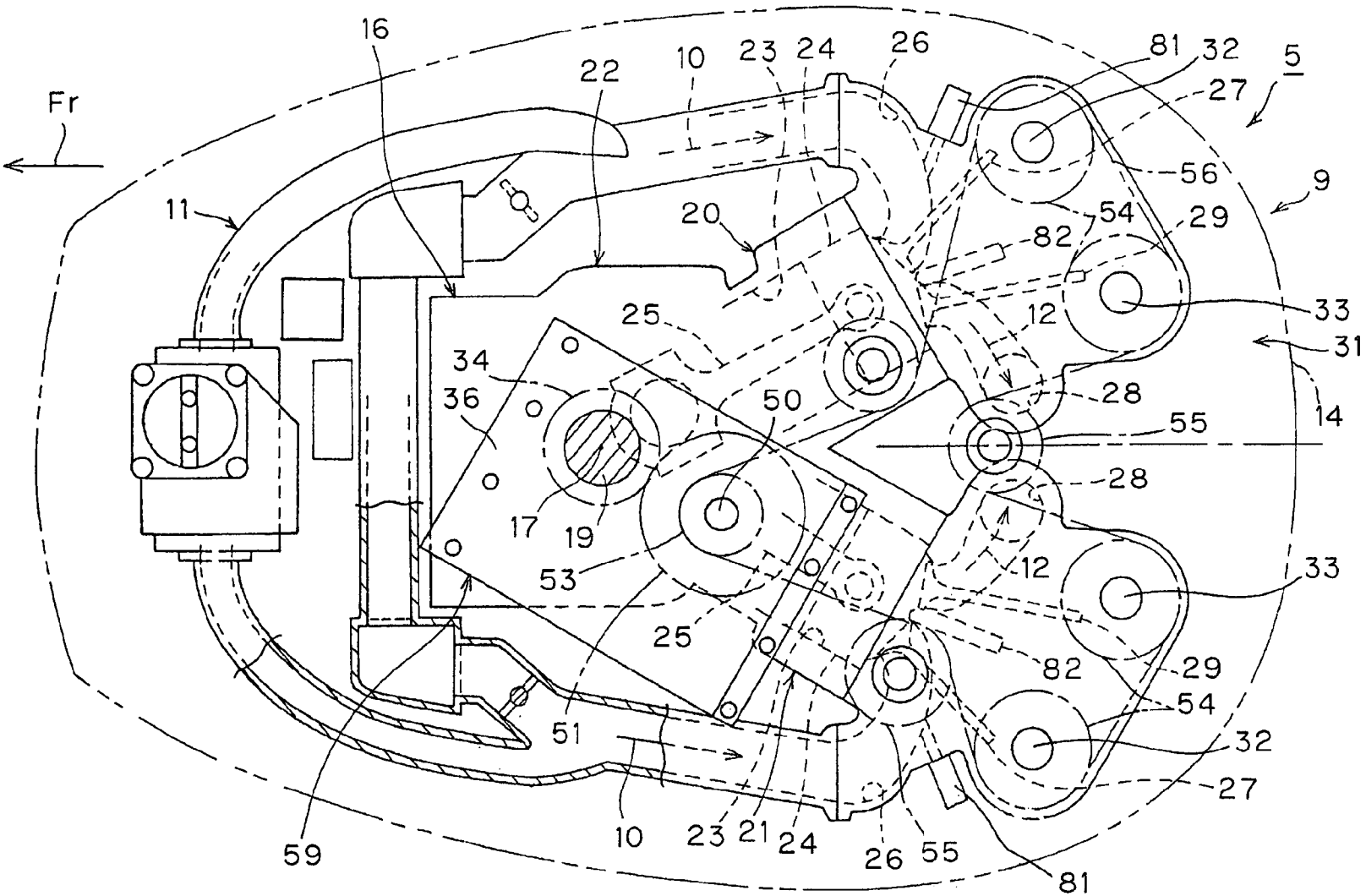
FIG. 2 is a top plan of the outboard motor of FIG. 1 with a portion of the engine shown in cross-section.

With reference to FIGS. 1 and 2, the internal combustion engine 9 can be a four-stroke, V-type, multiple-cylinder engine that has a crankcase 16 supported on the upper side of the casing 7. The engine 9 includes a crankshaft 19 that can have a vertically-extending axial center 17. The crank shaft 19 can be supported for rotation in the crankcase cylinder head assemblies 20, 21 that can protrude forwardly from the crankcase 16 in the general shape of a letter V. Each of these cylinder head assemblies 20, 21 can include a plurality (e.g., three) of vertically arranged cylinder bodies or cylinders. In the illustrated embodiment, the crankcase 16 and the cylinders head assemblies 20, 21, which protruded from the crankcase 16, form, at least in part, an engine outer body 22.

While the engine 9 of the illustrated embodiment is a four-stroke, V-type, multiple-cylinder type engine, it should also be appreciated that various features, aspects and advantages of the present invention may be used with engines operating on different cycles (e.g., 2-cycle) and having any of a variety of configurations including a different numbers of cylinders and different cylinder arrangements (W, opposing, etc.).

With particular reference to FIG. 2, in the illustrated embodiment, pistons 24 are inserted in cylinder bores 23 formed in the cylinder bodies of the cylinder head assemblies 20, 21, respectively. The pistons 24 can be drivingly connected to the crankshaft 19 by connecting rods 25. Each of the cylinders in the cylinder head assemblies 20, 21 can be provided with an intake passage 26 for communication with a combustion chamber of the cylinder bore 23 from the outside and an intake valve 27 for opening/closing the intake passage 26. Each of the cylinder bodies can be provided with an exhaust passage 28 for communication of the combustion chamber of the cylinder bore 23 with the outside and with an exhaust valve 29 for opening/closing the exhaust passage 28. In other embodiments, each cylinder body can be provided with multiple intake and/or exhaust valves.

As shown in FIG. 2, the internal combustion engine 9 can be provided with the valve drive mechanism 31 that is configured to drivingly couple the intake valve 27 and exhaust valve 29 to the crankshaft 19 in order to appropriately open/close these valves 27, 29.

Figure 3:
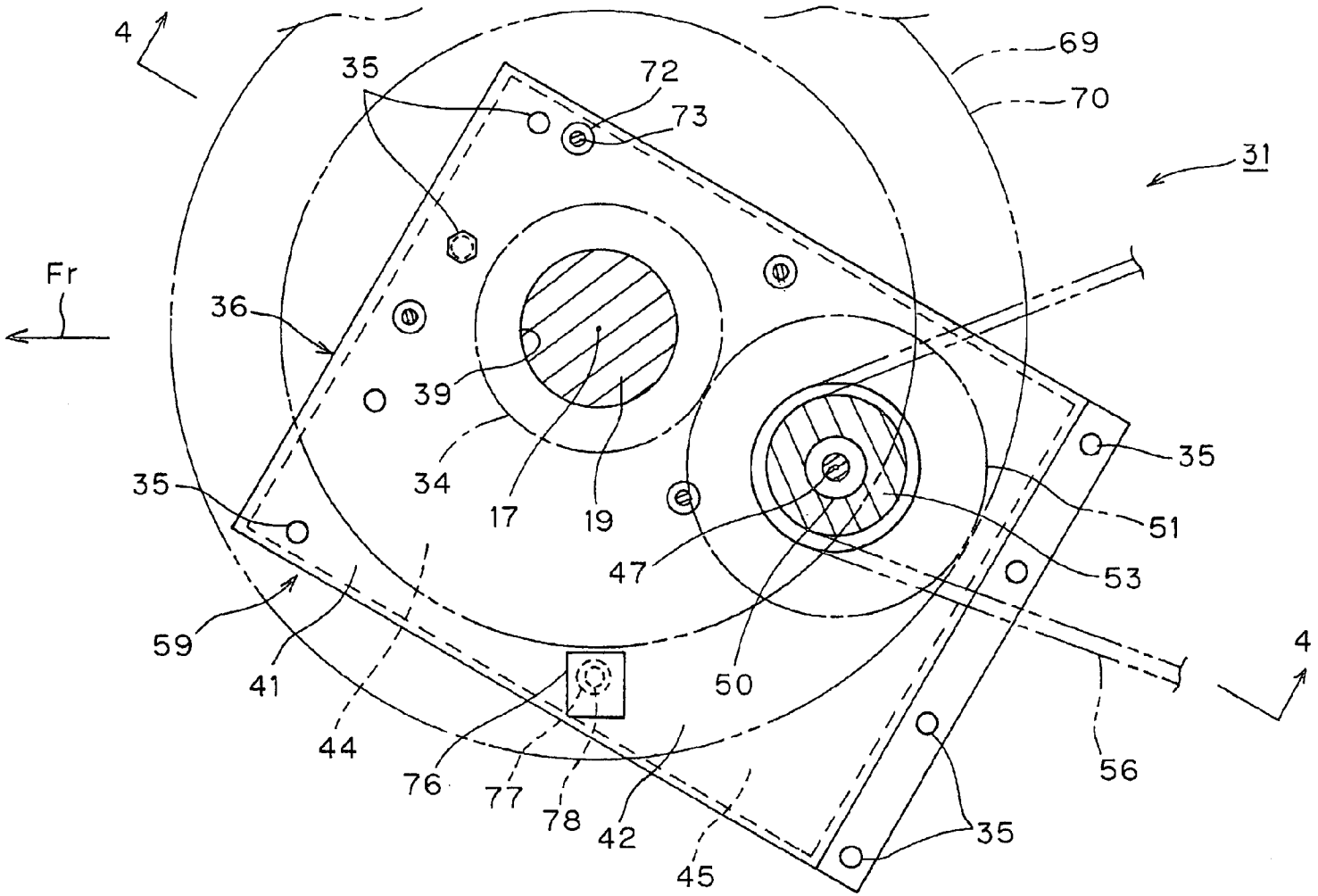
FIG. 3 is an enlarged view of a central portion of FIG. 2.
Figure 4:
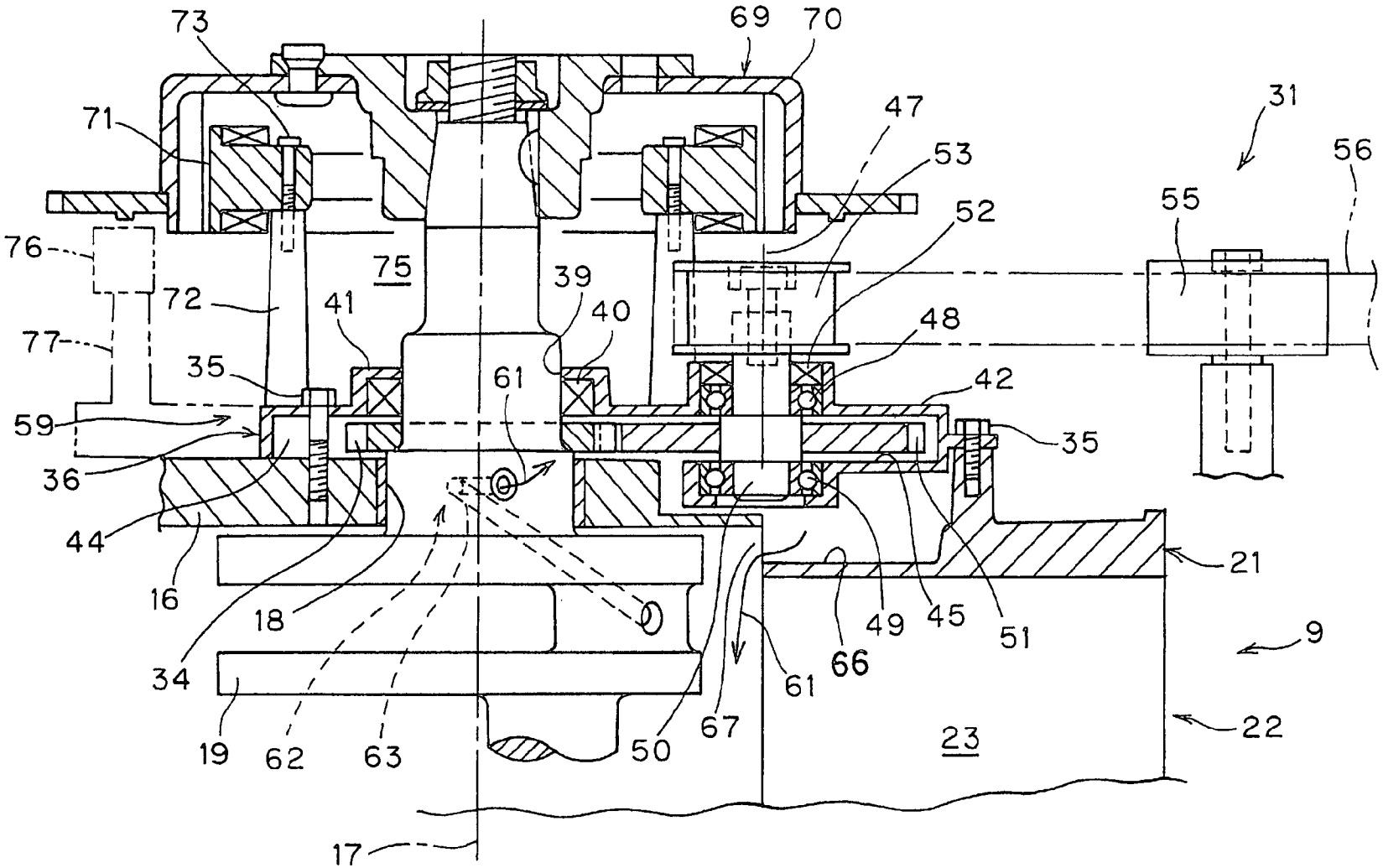
FIG. 4 is cross-sectional view taken along line 4-4 of FIG. 3.

In the illustrated embodiment, the valve drive mechanism 31 can include camshafts 32, 33 that are supported for rotation on the cylinder head assemblies 20, 21. The camshafts 32, 33 can be configured to engage the intake and exhaust valves 27, 29 through cams (not shown) as is known in the art. As will be explained in more detail below, the drive mechanism 31 can also include a drive gear 34 that is supported on an upwardly protruding portion of the crankshaft 19 (see FIG. 4). In one embodiment, the drive gear 34 is formed, at least in part, from plastic. With reference to FIGS. 3-4, a bracket 36 can be provided separately from an upper part of the engine outer body 22 and can be detachably fastened to the upper side of the engine outer body 22 with a fastener 35. In one embodiment, the bracket 36 can be made of an aluminum alloy casting.

With continued reference to FIGS. 2-4, in the illustrated embodiment, the bracket 36 can have a flat, box-like shape that extends in a generally horizontal direction. With reference to FIG. 4, the bracket 36 can be formed with a round through-hole 39 on the axial center 17 of the crankshaft 19. The through-hole 39 can be configured such that when it is fitted on the crankshaft 19 there is no play. As a result of this fitting, the bracket 36 can be positioned with respect to a given position on the upper surface of the engine outer body 22. A seal body 40 can be provided for sealing the space between the outside circumferential surface of the crankshaft 19 and the edge portion of the through-hole 39. The seal body 40 can be mounted to the bracket 36.

With continued reference to FIG. 4, the bracket 36 can be provided with a bracket base 41 that is coupled to the upper surface of the crankcase 16. The bracket 36 can also be provided with a bracket body 42 that can be integrally formed with the bracket base 41 and can be located at a distance above from the upper surface of the engine outer body 22. The bracket base 41 can form, at its bottom end, a first gear chamber 44. The first gear chamber 44 can have a downwardly facing opening that is closed by the upper surface of the body 42 can form a second gear chamber 45, which can be in communication with the first gear chamber 44 as shown in FIG. 4.

In the illustrated embodiment, the valve drive mechanism 31 can have a rotating shaft 50 (see FIG. 4) that has a generally vertically-extending axial center 47. The rotating shaft 50 can be supported for rotation on the bracket body 42 by upper and lower bearings 48, 49. A driven gear 51 can be mounted to the rotating shaft 50 between the two bearings 48 and 49. The driven gear 51 can be formed from a plastic. A seal body 52 can be provided for sealing the space between the upper end portion of the bracket body 42 and the rotating shaft 50. The rotating shaft 50 can be supported by the bracket body 42 on the engine outer body 22 and can pass through the second gear chamber 45 of the bracket body 42. Thus, in the illustrated embodiment, the driven gear 51 can be housed in the second gear chamber 45 and arranged such that it meshes or otherwise engages with the drive gear 34.

With reference to FIGS. 2 and 4, the valve drive mechanism 31 can include a drive pulley 53 that is mounted to the upper end of the rotating shaft 50. Driven pulleys 54, in turn, can be mounted to the camshafts 32, 33. A plurality of idle pulleys 55 can be supported for rotation on the upper side of the engine outer body 22. A transmitter member 56 (e.g., a belt) can be stretched or placed over these pulleys 53, 54, 55 as shown in FIG. 2.

In the illustrated embodiment, the bearings 48, 49, the rotating shaft 50, the driven gear 51, the seal body 52, the drive pulley 53, and/or the bracket 36 can form a unit 59, which can be pre-assembled together. The unit 59 can be coupled to the upper side of the engine outer body 22 with the fastener 35 or otherwise detachable coupled to the outer body 22.

With reference to FIG. 4, the internal combustion engine 9 can be provided with a lubrication device 62 that is configured to lubricate portions of the internal combustion engine 9 with a lubricant (e.g., oil). Portions of the lubrication device 62 will now be described. A lubricant passage 63 can be provided in the crankshaft 19. Lubricant 61 can be drawn from the bottom of the crankcase 16 and pressurized. The lubricant 61 can then be supplied through the lubricant passage 63 to the bearing 18, which can be on the uppermost part of the crankcase 16. Drawing and pressurization of the lubricant 62 can be performed by a lubricant pump (not shown), which can be driven by the crankshaft 19 as is know in the art. Part of the lubricant 61 supplied to the bearing 18 can also be supplied to the first gear chamber 44. Accordingly, a part of the lubricant 61 can reach and lubricate the meshing or engaging sections of the drive gear 34 and driven gear 51. With the help of the centrifugal force of the drive gear 34, the lubricant 61 can also reach the second gear chamber 45 and lubricate the bearings 48, 49 in this chamber 45.

In the illustrated embodiment, the connecting rods 25 of one cylinder head assembly 20 and the other cylinder head assembly 21 can be fitted on the crankshaft 19 alternately in its axial direction. Thus, one cylinder head assembly 20 can have its upper surface at a position higher than the upper surface of the other cylinder head assembly 21. With reference to FIG. 4, the bearings 48 and 49, the rotating shaft 50 and the driven gear 51 can be disposed, at least partially, in the upper section of the other cylinder head assembly 21. The upper surface of the other cylinder head assembly 21 can constitutes a lubricant storage section 66, and a communication path 67 for communication of the bottom of the lubricant storage section 66 with the crankcase 16.

After lubricating the meshing section of the drive and driven gears 34 and 51, and the bearings 48 and 49, lubricant 61 can flow down by gravity through the lubricant storage section 66 and the communication path 67 into the crankcase 16. The lubricant 61 can then be returned to the bottom of the crankcase 16 and be drawn again by the lubricant pump.

With continued reference to FIG. 4, a flywheel magneto can be provided as an auxiliary machine 69 of the internal combustion engine 9. The auxiliary machine 69 can have a rotor 70 supported on the upper end of the crankshaft 19 and a stator 71 supported on a side of the bracket 36. The illustrated embodiment can be provided with a plurality (e.g., four) of stays or supports 72, which each can be formed integrally with the bracket 36. The stays 72 can protrude upwardly from the upper surface of the bracket 36. The stator 71 can be supported on the upper ends of the stays 72 and fastened thereto with fasteners 73. The unit 59 can be disposed in a vacant space 75 interposed between the upper surface of the bracket 36 and the auxiliary machine 69.

A detection sensor 76 can be provided for detecting the number of revolutions of the internal combustion engine 9. Another stay 77 can be formed integrally or otherwise coupled on the upper surface of the bracket 36. The detection sensor 76 can be detachably fastened to the protruded end of the stay 77 with a fastener 78.

The engine 9 can also include a fuel injection valve 81 and an ignition plug 82 as shown in FIG. 2.

In one embodiment of operation, part of drive force outputted from the crankshaft 19 can be transmitted to the camshafts 32, 33 through, in order, the drive gear 34, the driven gear 51, the rotating shaft 50, the drive pulley 53, the transmitter member 56 and the driven pulley 54. Then, the intake and exhaust valves 27, 29 can be moved in association with these camshafts 32, 33 to maintain operation of the internal combustion engine 9.

In the illustrated embodiment, the drive gear 34 and/or driven gear 51 can be made of plastic. This can advantageously reduce meshing sounds and the weight of the valve drive mechanism 31.

Another advantage of the illustrated embodiment is that the bearing 18 of the crankshaft 19, the meshing section of the drive and driven gears 34, 51, and the bearings 48, 49 of the rotating shaft 50 can be lubricated with lubricant 61 in association with the crankshaft 19. This facilitates maintaining smooth operation of the internal combustion engine 9.

With reference to FIG. 1, in the illustrated embodiment, the propeller 8 can be driven for rotation the drive force of the internal combustion engine 9 for the propulsion of the watercraft 1.

According to an embodiment described above, the bracket 36 can be formed separate from the engine outer body 22 and can be mounted to the engine outer body member 22 for supporting the rotating shaft 50 through the bearings 48, 49. The bearings 48, 49, the rotating shaft 50, the driven gear 51, the drive pulley 53 and the bracket 36 can be assembled as a unit 59. The unit 59, in turn, can be mounted as an integral unit to the engine outer body 22.

Figure 5:
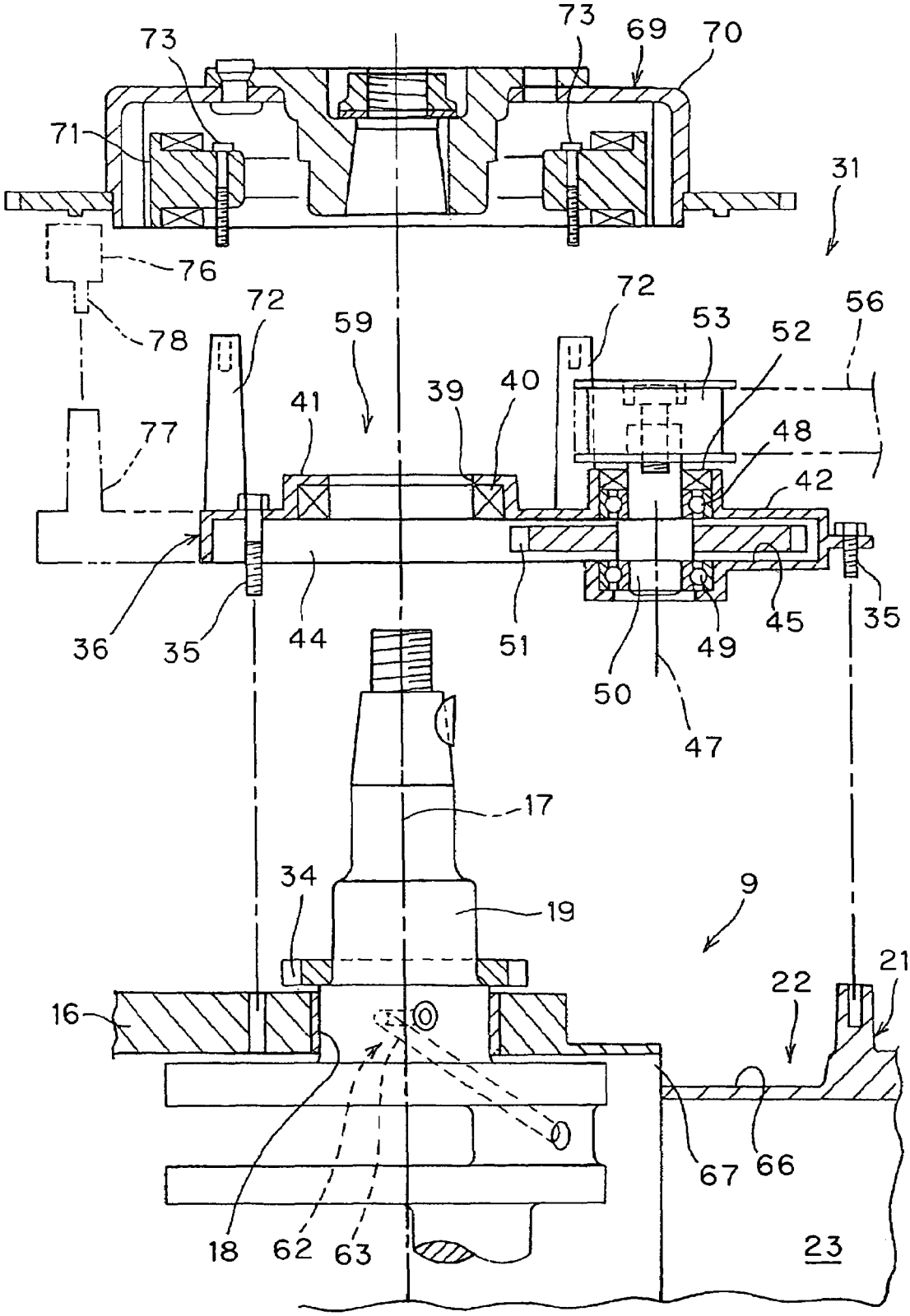
FIG. 5 is an exploded cross-sectional view of the valve drive mechanism of FIG. 4.

With particular reference to FIG. 5, in the illustrated embodiment, the valve drive mechanism 31 in the internal combustion engine 9 can be assembled by first mounting the drive gear 34 to the crankshaft 19. In the wide working space spreading outside the engine outer body 22, the seal body 40, the bearings 48, 49, the rotating shaft 50, driven gear 51, the seal body 52 and/or the drive pulley 53 can be assembled to the bracket 36 to form a pre or partially pre-assembled unit 59. Then, this unit 59 can be mounted to the engine outer body 22 to complete the assembly work.

Therefore, according to the illustrated embodiment, assembly work can be performed more easily as compared to when components of the valve drive mechanism 31 are assembled separately to the engine outer body 22 as is done in the prior art.

An additional advantage of the illustrated embodiment is that a through-hole 39 for the crankshaft 19 can be formed in the bracket 36. Therefore, in the foregoing assembly procedure, the through-hole 39 of the bracket 36 can be fitted on the crankshaft 19 and the bracket 36 can be accurately positioned with respect to a given position on the engine outer body 22. Thus, the assembly work can be performed more easily and quickly.

A further advantage of the illustrated embodiment is that the first and second gear chambers 44, 45 for housing the drive gear 34 and driven gear 51 can be formed in the bracket 36. Part of lubricant 61 that is supplied from the bottom of the crankcase 16 to a bearing 18 that supports the crankshaft 19 can also be supplied to the first and second gear chambers 44, 45. Therefore, lubrication of the meshing or engaging sections of the drive and driven gears 34, 51 and the bearings 48, 49 can be achieved by supplying lubricant 61 leaking from the bearing 18 of the crankshaft 19 to the first and second gear chambers 44 and 45. In a modified embodiment, a guide groove(s) or the like can be machined in the crankshaft 19 and lubrication can be achieved by supplying lubricant 61 to the first and second gear chambers 44, 45 through the guide groove(s). However, the illustrated embodiment advantageously provides a lubrication structure with fewer parts, which in turn simplifies the structure of the valve drive mechanism 31.

Further, in the illustrated embodiment, part the lubricant 61 supplied to the bearing 18 supporting the crankshaft 19 can be utilized for lubrication of the meshing section, of the drive and driven gears 34, 51 provided outside the engine outer body 22 and/or other elements. Therefore, in the illustrated embodiment, the bearing 18 need not be provided with a seal body for preventing lubricant 61 from leaking outwardly from the engine outer body 22. In this manner, the structure of the valve drive mechanism 31 can be simplified further.

A further advantage of the illustrated embodiment is that the valve drive mechanism 31 can be configured for a multiple-cylinder, V-type internal combustion engine in which the crankshaft 19 can extend vertically, left and right cylinder head assemblies or banks 20, 21 protrude from the crankcase 16, and of these two cylinder head assemblies 20,21, one cylinder head assembly 20 has its upper surface at a position higher than the upper surface of the other cylinder head assembly 21 and the driven gear 51 is disposed in the upper section of the other cylinder head assembly 21. In such an engine, the engine outer body 22 and the driven gear 51 are compactly disposed, so that the internal combustion engine 9 can be decreased in size.

A further advantage of the illustrated embodiment is that the lubricant 61, after lubricating the meshing section of the drive and driven gears 34, 51, and the like, can be collected onto the upper surface of the other cylinder head assembly 21 of lower height. Thus, lubricant 61 can be returned to the bottom of the crankcase 16 from the upper surface of the other cylinder head assembly 21.

A further advantage of the illustrated embodiment is that the internal combustion engine 9 can be used in an outboard motor 5 in which the crankshaft 19 extends vertically, the bracket 36 is disposed in the upper section of the engine outer body 22, a stay 72 is protruded upwardly from the bracket 36, and an auxiliary machine 69 is supported on the stay 72. Therefore, the bracket 36 of the valve drive mechanism 31 can be utilized for the support of the auxiliary machine 69. Thus, the internal combustion engine 9 can be decreased in the number of components and simplified in structure, as well as becoming lighter in weight. Further, since the bracket 36, stay 72 and auxiliary machine 69 can be located in the upper section of the engine outer body 22, the illustrated embodiment is particularly advantageous to an outboard motor 5 for which widthwise dimensions are required to be kept small.

Another advantage of the illustrated embodiment is that the unit 59 can be disposed in a vacant space 75 interposed between the upper surface of the bracket 36 and the auxiliary machine 69. Therefore, the bracket 36, unit 59 and auxiliary machine 69 can be disposed in a compact arrangement and thus the internal combustion engine 9 can be decreased in size.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. For example, although the illustrated embodiment has been described according to the example shown in the figures, the drive gear 34 and driven gear 51 may be made of metal. In addition, in other embodiments, the pulleys 53-55 can be replaced by sprocket wheels, and/or the transmitter member 56 by a chain.

In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve drive mechanism for an internal combustion engine that includes an outer body formed, at least in part, by a crankcase and a cylinder head assembly that protrudes from the crankcase, the valve drive mechanism comprising a drive gear that is mounted on a crankshaft supported on the crankcase, a shaft that is supported for rotation by a bearing, a driven gear mounted on the shaft, the driven gear configured to mesh with the drive gear, a drive pulley mounted to the shaft; a driven pulley mounted to a camshaft supported on the cylinder head assembly, a transmitter member that extends between the drive pulley and the driven pulley, and a bracket that is a separate component from the engine outer body and is configured to be mounted to the engine outer body, the bracket configured to support the bearing and the rotating shaft, wherein the bracket, the bearing, the rotating shaft, the driven gear, the drive pulley and the bracket form a unit that is configured to be mounted together to the outer body.

2. The valve drive mechanism as in claim 1, wherein the bracket comprises a through-hole that is configured to be fitted over an upper end of the crankshaft.

3. The valve drive mechanism as in claim 1, wherein the bracket forms a gear chamber that houses the drive gear and the driven gear.

4. The valve drive mechanism as in claim 3, wherein valve drive mechanism is configured such that at least a portion of lubricant, which is supplied to a bearing supporting the crankshaft on the crankcase, is supplied to the gear chamber.

5. The valve drive mechanism of claim 1, wherein the bracket is configured to be mounted onto an engine in which the crankshaft extends in a generally vertical direction and the engine comprises multiple-cylinders in a V-type orientation comprising first and second cylinder banks that protrude from the crankcase.

6. The valve drive mechanism of claim 5, wherein one of the first and second cylinder banks has an upper surface at a position higher than an upper surface of an other, lower cylinder bank and the bracket is configured such that the driven gear is disposed above the other, lower cylinder bank.

7. The valve drive mechanism of claim 1, wherein the internal combustion engine is configured for an outboard motor where the crankshaft extends in a generally vertical direction and wherein the bracket is configured to be disposed above the outer body of the engine.

8. The valve drive mechanism of claim 7, further comprising a stay that protrudes upwardly from the bracket and an auxiliary machine that is supported on the stay above the drive gear.

9. The valve drive mechanism of claim 8, wherein the auxiliary machine is a flywheel magneto.

10. The valve drive mechanism of claim 1, wherein the transmitter member comprises a timing belt.

11. The valve drive mechanism of claim 1, wherein the drive and driven gears are formed at least in part of plastic.

12. A valve drive mechanism for an internal combustion engine that includes a crankcase, a cylinder body that protrudes from the crankcase, a generally vertically extending crankshaft, and a drive gear coupled to an upper portion of the crankshaft, the valve drive mechanism comprising a pre-assembled unit that includes a bracket; a bearing coupled to the bracket, a shaft that is journalled for rotation by the bearing, a driven gear that is coupled to the shaft and is configured to be engaged and driven by the drive gear; a drive pulley coupled to the shaft, and a transmitter member that can be placed over the drive pulley and over a driven pulley that is coupled to a camshaft of the internal combustion engine.

13. The valve drive mechanism as in claim 12, wherein the bracket comprises a through-hole that is configured to be fitted over an upper end of the crankshaft.

14. The valve drive mechanism as in claim 12, wherein the bracket forms a gear chamber with a downwardly facing opening configured to fit over the drive gear, the gear chamber configured to house both the drive gear and the driven gear when the bracket is coupled to the engine.

15. The valve drive mechanism as in claim 14, wherein the gear chamber is configured such that at least a portion of lubricant supplied to a bearing supporting the crankshaft on the crankcase is supplied to the gear chamber.

16. The valve drive mechanism of claim 12, wherein the bracket is configured to be mounted onto an engine that comprises multiple-cylinders in a V-type orientation that includes first and second cylinder banks that protrude from the crankcase.

17. The valve drive mechanism of claim 16, wherein one of the first and second cylinder banks has an upper surface at a position higher than an upper surface of an other, lower cylinder bank and the bracket is configured such that the driven gear is disposed above the other, lower cylinder bank.

18. The valve drive mechanism of claim 12, wherein the unit further comprises a stay that protrudes upwardly from the bracket, the stay being configured to support and an auxiliary machine above the drive gear.

19. The valve drive mechanism of claim 18, wherein the auxiliary machine is a flywheel.

20. The valve drive mechanism of claim 19, wherein the auxiliary machine comprises a stator supported by the bracket.

21. The valve drive mechanism of claim 12, wherein the transmitter member comprises a belt.

22. The valve drive mechanism of claim 12, wherein the driven gear is formed at least in part of plastic.

23. The valve drive mechanism of claim 12, wherein the bearing comprises a pair of bearing members between which the driven gear is located on the rotating shaft.

24. A valve drive mechanism for an internal combustion engine that includes a crankcase, a cylinder body that protrudes from the crankcase, a generally vertically extending crankshaft, and a drive gear coupled to an upper portion of the crankshaft, the valve drive mechanism comprising a bearing; a shaft that is journalled for rotation by the bearing; a driven gear that is coupled to the shaft and is configured to be engaged and driven by the drive gear; a drive pulley coupled the shaft; and a transmitter member that can be placed over the drive pulley and over a driven pulley that is coupled to a camshaft of the internal combustion engine, and means for coupling the drive gear, the shaft, and the pulley to the engine as a pre-assembled unit that can be coupled to the crankcase or cylinder body.

* * * * *